United States Patent [19]

Stewart et al.

[11] Patent Number: 4,759,136

[45] Date of Patent: Jul. 26, 1988

[54] ATHLETIC SHOE WITH DYNAMIC CRADLE

[75] Inventors: Douglas Stewart, Needham; Juan A. Diaz, Weymouth, both of Mass.

[73] Assignee: Reebok International Ltd., Canton, Mass.

[21] Appl. No.: 11,531

[22] Filed: Feb. 6, 1987

[51] Int. Cl.[4] ..... A43B 13/04; A43B 13/18

[52] U.S. Cl. ..... 36/114; 36/30 R; 36/31; 36/32 R

[58] Field of Search ..... 36/114, 30 R, 31, 32 R, 36/25 R, 37, 129, 102

[56] References Cited

U.S. PATENT DOCUMENTS

| | | | |
|---|---|---|---|
| 4,043,058 | 8/1977 | Hollister et al. | 36/102 |
| 4,237,627 | 12/1980 | Turner | 36/129 |
| 4,302,892 | 12/1981 | Adamik | 36/31 |
| 4,364,188 | 12/1982 | Turner et al. | 36/31 |
| 4,490,928 | 1/1985 | Kawashima | 36/31 X |
| 4,551,930 | 11/1985 | Graham et al. | 36/30 R |
| 4,614,046 | 9/1986 | Dassler | 36/30 R |
| 4,624,061 | 11/1986 | Wezel et al. | 36/32 R |
| 4,667,423 | 5/1987 | Autry et al. | 36/30 R |

FOREIGN PATENT DOCUMENTS

| | | | |
|---|---|---|---|
| 2836793 | 3/1980 | Fed. Rep. of Germany | 36/30 R |
| 3347343 | 7/1985 | Fed. Rep. of Germany | 36/114 |
| 58-49101 | 3/1983 | Japan | 36/30 R |
| 59-168802 | 9/1984 | Japan | 36/25 R |

*Primary Examiner*—James Kee Chi

*Attorney, Agent, or Firm*—Saidman, Sterne, Kessler & Goldstein

[57] ABSTRACT

A lightweight athletic shoe includes a midsole of compressible material having portions of differing hardness which limit overpronation and effectively absorb shock while conforming to the shape of the foot. The midsole includes a central portion of relatively soft material, a lower peripheral portion of intermediate hardness extending around the central portion in the heel region and forward along each side to the toe region, and a raised upper peripheral portion of relatively hard material located above the lower peripheral portion and extending forward to the ball region of the midsole. The central portion conforms to the contour of the foot so that the force is uniformly distributed, while the peripheral portions cradle the sides of the foot so as to limit overpronation and oversupination.

16 Claims, 3 Drawing Sheets

ATHLETIC SHOE WITH DYNAMIC CRADLE

FIELD OF THE INVENTION

This invention relates to footwear and, more particularly, to footwear having a midsole construction which limits overpronation and oversupination and effectively absorbs shock while conforming to the shape of the foot. The midsole construction is intended for use in athletic shoes, but is not limited to such use.

BACKGROUND OF THE INVENTION

Each time the foot of a runner contacts the ground, considerable shock force is transmitted through the shoe to the wearer's foot. After a time, this shock force can result in fatigue and discomfort. Various shock-absorbing sole materials have been utilized to absorb at least a portion of the shock and to thereby overcome this problem.

Immediately following foot contact with the ground, the foot tends to roll about its long axis towards the inside, or medial side. This rolling is called pronation. Oversupination is a tendency to roll in the opposite direction. Overpronation is the cause of many running injuries such as Achilles tendinitis, plantar fasciitis and knee and hip pain. Prior art attempts to overcome overpronation have included firm heel counters, extended arch supports, filled in midsoles underneath the arch and higher density midsoles usually on the medial side. One prior art shoe incorporated a higher density midsole on the lateral side in order to restrict supination.

It is desirable to provide a midsole construction which limits overpronation and oversupination and which absorbs shock so as to improve comfort and reduce the tendency for fatigue and injury.

It is a general object of the present invention to provide an improved athletic shoe.

It is a further object of the present invention to provide an athletic shoe having a midsole which effectively absorbs shock and limits overpronation of the wearer's foot.

It is a further object of the present invention to provide an athletic shoe which is comfortable during prolonged use and reduces the tendency for fatigue and injury.

SUMMARY OF THE INVENTION

According to the present invention, these and other objects and advantages are achieved in footwear comprising an upper and a sole, the sole including an outsole and a midsole of compressible material and having a heel region and a toe region. The midsole includes a central portion of relatively soft material, a lower peripheral portion of intermediate hardness extending around the central portion in the heel region and forward along each side of the central portion to the toe region, and an upper peripheral portion of relatively hard material located above the lower peripheral portion and extending from the heel region forward to the ball region of the midsole. The central portion absorbs shock by conforming to the contour of the foot so that the force is uniformly distributed and, in addition, motion of the foot relative to the shoe is limited. The peripheral portions also cradle the sides of the foot so as to limit overpronation.

The upper peripheral portion is raised above the surface of the central portion, thereby defining a foot-retaining lip, and is tapered in thickness toward the toe region of the midsole. Since the outer peripheral portion is harder than the central portion, the foot does not compress it and pronation is limited. In a preferred embodiment, the midsole is made of ethyl vinyl acetate and the central portion has a hardness of about 55 Asker C durometer, the lower peripheral portion has a hardness of about 60 Asker C durometer and the upper peripheral portion has a hardness of about 65 Asker C durometer. To further limit pronation, the peripheral portions can be fabricated with the medial side harder than the lateral side.

BRIEF DESCRIPTION OF THE DRAWINGS

For a better understanding of the present invention together with other and further objects, advantages and capabilities thereof, reference is made to the accompanying drawings which are incorporated herein by reference and in which.

DETAILED DESCRIPTION OF THE INVENTION

Figure 1:
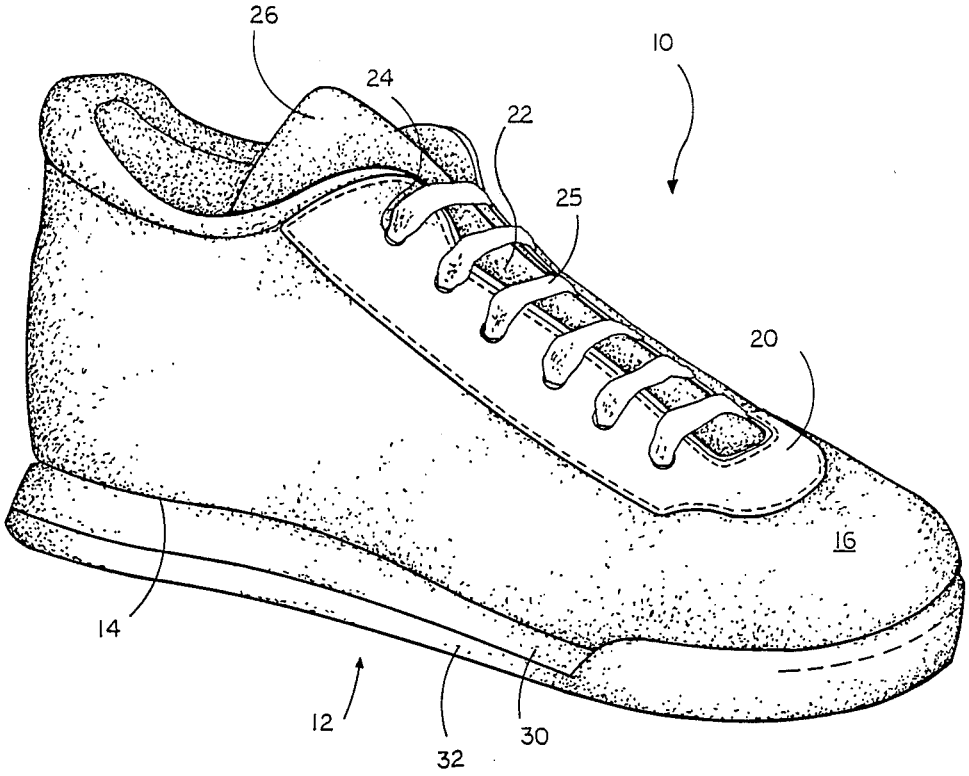
FIG. 1 is a perspective view of an athletic shoe in accordance with the present invention.

A laced, lightweight athletic shoe in accordance with the present invention is shown in FIG. 1. An upper 10 is joined to a sole 12 at a lasting margin 14. A top 16, or vamp, of a light, flexible material such as leather extends from the rear of the heel along the sides and covers the toe portion. A U-shaped lacing margin 20 is stitched to the top and defines a lacing opening 22. The lacing margin 20 is provided with a plurality of lacing holes 24 for a lace 25. A tongue 26 underlies the lacing margin 20 and the lacing opening 22. The sole 12 includes a midsole 30 and outsole 32, usually having a tread pattern. The present invention can also be utilized in a shoe with hook and loop type fasteners, such as Velcro fasteners.

The midsole 30 of the present invention, referred to herein as a "dynamic cradle" midsole, includes three portions of different densities arranged to prevent overpronation and oversupination and to cushion the shock of impact in a desirable manner. The midsole of the present invention stabilizes the foot to encourage a more efficient pattern of motion, one that lies within the normal range of motion. The foot structure is such that it appears to work best on moderately soft surfaces. Flat asphalt or concrete surfaces do not conform to the shape of the foot, nor do they envelop the lower portions of the sides of the foot. The bottom of the foot is not flat and the foot's motion is best restricted when the surface underneath it depresses to more closely conform to the plantar aspect of the foot, as well as to envelop the lower part of the foot. The dynamic cradle midsole of the present invention provides such an environment.

Figure 2:
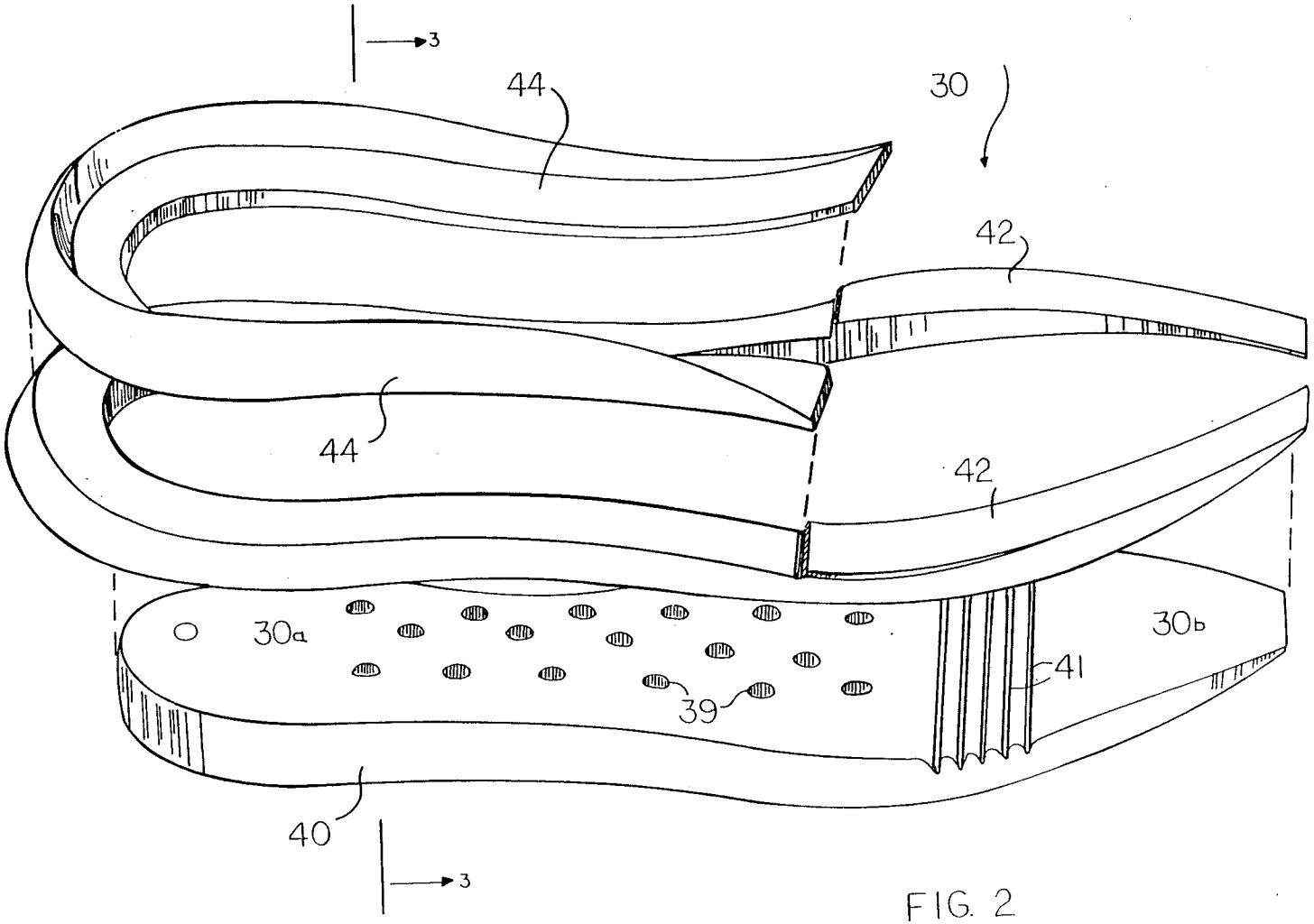
FIG. 2 is an exploded view of the midsole in accordance with the present invention.
Figure 3:
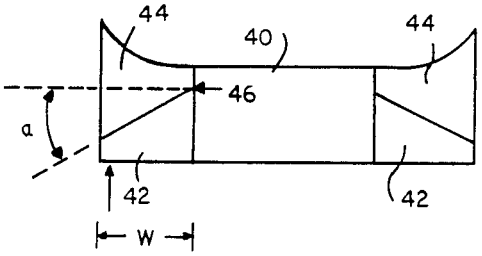
FIG. 3 is a cross-section of the midsole taken through the line 3—3 of FIG. 2 after assembly of the sections.

Referring now to FIGS. 2 and 3, the midsole 30 of the present invention is formed of compressible material and has three sections, or portions, of differing hardness. A central portion 40 extends from a heel region **30*a* forwardly to the front edge of a toe region 30*b* and is made of relatively soft material, that is, material of a lower hardness value than the other two midsole portions. The central portion 40 can be provided with holes 39 for improved flexibility and reduced weight, and with grooves 41 for flexibility. A lower peripheral portion 42 extends around the central portion 40 in the heel region 30***a* and forward along each side of the central portion 40 to the front edge of the toe region 30*b*. The lower peripheral portion 42 has an intermediate hardness value relative to the other two midsole portions. An upper peripheral portion 44 is located above the lower peripheral portion 42 and extends from the heel region 30*a* forward along each side of the central portion 40 and terminates in the ball region of the midsole. The upper peripheral portion 44 has a higher hardness value than the other two midsole portions and at least part of it is raised above the surface of the central portion 40 to form a foot-retaining lip around the rear portion of the midsole 30. The lip is curved upwardly and outwardly from the central portion 40 toward the edge of the midsole to conform to the shape of the foot. The upper peripheral portion 44 is tapered toward the toe region of the midsole to zero thickness and forms a cradle which wraps up around the foot to prevent the foot from moving or rolling to either side.

The midsole 30 is preferably made of ethyl vinyl acetate having a specific gravity of 0.18 to 0.20, but can also be made of polyurethane, natural or synthetic rubber, other organic polymeric materials or a combination of these materials. In a preferred embodiment, the central portion 40 has a hardness of about 55 Asker C durometer, the lower peripheral portion 42 has a hardness of about 60 Asker C durometer and the upper peripheral portion 44 has a hardness of about 65 Asker C durometer. The central portion 40 is preferably in the range between 35 and 75 Asker C durometer, the lower peripheral portion 42 is preferably in the range between 40 and 80 Asker C durometer and the upper peripheral portion 44 is preferably in the range between 45 and 85 Asker C durometer. Most preferably, the central portion 40 is in the range between 50 and 60 Asker C durometer, the lower peripheral portion 42 is in the range between 55 and 65 Asker C durometer, and the upper peripheral portion 44 is in the range between 60 and 70 Asker C durometer. The hardness values specified herein are measured at a temperature of 72° F.±5° in a dry environment.

As seen in FIG. 3, the intersection between the lower peripheral portion 42 and the upper peripheral portion 44 is preferably angled downwardly and outwardly away from the central portion 40 at an angle a of about 30° in order to provide an optimum compromise between cushioning and control. The increased thickness of the upper peripheral portion 44 at the outermost periphery enhances the foot cradling or control effect. However, the angle a can be varied to achieve a desired performance, and can be zero if desired. A point 46 where the portions 40, 42, 44 intersect is preferably about two-thirds of the distance from the bottom surface to the top surface of central portion 40. Preferably, the lower peripheral portion 42 has a width w in the range between 2 mm and 25 mm and most preferably is in the range between 8 mm and 12 mm. In a preferred embodiment, the width w is about 11 mm in width.

The midsole 30 can be constructed so that either the lower peripheral portion 42 or the upper peripheral portion 44, or both, have different hardness values on their medial and lateral sides. In addition, the upper peripheral portion 44 which wraps around the lower portion of the foot can be made higher on the lateral or medial side. The example, the upper peripheral portion 44 can be made higher on the medial side and of harder material in order to limit pronation.

In operation, the dynamic cradle midsole 30 of the present invention compresses more in the relatively soft central portion 40 upon impact and less in the peripheral region of harder material, thereby cradling the foot and absorbing shock. The central portion 40 conforms to the shape of the foot so that the shock force is distributed over the area of the foot and relative motion between the foot and the shoe is limited or prevented. As a result, the tendency for fatigue and injury is lessened. The harder materials underneath the edges of the foot in the lower peripheral portion 42, and the even harder material wrapping up around the foot in the upper peripheral portion 44, do not compress as much as the softer material in the central portion 40, thereby forming a stabilizing ring which envelops the foot and prevents the foot from moving excessively in either a supinatory or pronatory direction.

While there has been shown and described what is at present considered the preferred embodiments of the present invention, it will be obvious to those skilled in the art that various changes and modifications may be made therein without departing from the scope of the invention as defined by the appended claims.

What is claimed is:

1. Footwear, comprising:

an upper and a sole, said sole including an outsole and a midsole of compressible material and having a heel region and a toe region, said midsole including a central portion of relatively soft material, a lower peripheral portion of intermediate hardness extending around the central portion in the heel region and forward along each side of the central portion to the toe region, and an upper peripheral portion of relatively hard material located above said lower peripheral portion and extending from the heel region forward along each side of said central portion, whereby the central portion absorbs shock by conforming to the contour of the foot so that the force is uniformly distributed, while the peripheral portions cradle the sides of the foot so as to limit overpronation and oversupination.

2. Footwear as defined in claim 1 wherein said upper peripheral portion is raised above the surface of said central portion, thereby defining a foot-retaining lip on said midsole.

3. Footwear as defined in claim 2 wherein said foot-retaining lip is tapered in thickness toward the toe region of said midsole.

4. Footwear as defined in claim 1 wherein said central portion has a hardness in the region between 35 and 75 Asker C durometer, said lower peripheral portion has a hardness in the range between 40 and 80 Asker C durometer and said upper peripheral portion has a hardness in the range between 45 and 85 Asker C durometer.

5. Footwear as defined in claim 1 wherein said central portion has a hardness in the range between 50 and 60 Asker C durometer, said lower peripheral portion has a hardness in the range between 55 and 65 Asker C durometer and said upper peripheral portion has a hardness in the range between 60 and 70 Asker C durometer.

6. Footwear as defined in claim 1 wherein said central portion has a hardness of about 55 Asker C durometer, said lower peripheral portion has a hardness of about 60 Asker C durometer and said upper peripheral portion has a hardness of about 65 Asker C durometer.

7. Footwear as defined in claim 1 wherein said lower peripheral portion includes a medial side and a lateral side and wherein the medial side has a greater overall hardness than the lateral side.

8. Footwear as defined in claim 1 wherein said lower peripheral portion has a width in the range between 2 mm and 25 mm.

9. Footwear as defined in claim 1 wherein said lower peripheral portion has a width in the range between 8 mm and 12 mm.

10. Footwear as defined in claim 1 wherein said midsole comprises ethyl vinyl acetate.

11. Footwear as defined in claim 1 wherein the intersection between the lower peripheral portion and the upper peripheral portion is angled downwardly and outwardly away from the central portion.

12. Footwear as defined in claim 1 wherein said midsole comprises polyurethane.

13. Footwear as defined in claim 1 wherein said midsole comprises rubber.

14. An athletic shoe sole comprising:

an outsole and a midsole of compressible material and having a heel region and a toe region, said midsole including a central portion of relatively soft material, a lower peripheral portion of intermediate hardness extending around the central portion in the heel region and forward along each side of the central portion to the toe region, and an upper peripheral portion of relatively hard material located above said lower peripheral portion and extending from the heel region forward along each side of said central portion, whereby the central portion absorbs shock by conforming to the contour of the foot so that the force is uniformly distributed, while the peripheral portions cradle the sides of the foot so as to limit overpronation and oversupination.

15. An athletic shoe as defined in claim 14 wherein said central portion has a hardness in the range between 35 and 75 Asker C durometer, said lower peripheral portion has a hardness in the range between 40 and 80 Asker C durometer and said upper peripheral portion has a hardness in the range between 45 and 85 Asker C durometer.

16. An athletic shoe as defined in claim 14 wherein said central portion has a hardness in the range between 50 and 60 Asker C durometer, said lower peripheral portion has a hardness in the range between 55 and 65 Asker C durometer and said upper peripheral portion has a hardness in the range between 60 and 70 Asker C durometer.

* * * * *